US009573244B2

(12) United States Patent
Fukushima et al.

(10) Patent No.: US 9,573,244 B2
(45) Date of Patent: Feb. 21, 2017

(54) ELASTIC MEMBRANE, SUBSTRATE HOLDING APPARATUS, AND POLISHING APPARATUS

(71) Applicant: EBARA CORPORATION, Tokyo (JP)

(72) Inventors: Makoto Fukushima, Tokyo (JP); Hozumi Yasuda, Tokyo (JP); Keisuke Namiki, Tokyo (JP); Osamu Nabeya, Tokyo (JP); Shingo Togashi, Tokyo (JP); Satoru Yamaki, Tokyo (JP); Shintaro Isono, Tokyo (JP)

(73) Assignee: Ebara Corporation, Tokyo (JP)

( * ) Notice: Subject to any disclaimer, the term of this patent is extended or adjusted under 35 U.S.C. 154(b) by 21 days.

(21) Appl. No.: 14/668,844

(22) Filed: Mar. 25, 2015

(65) Prior Publication Data

US 2015/0273657 A1 Oct. 1, 2015

(30) Foreign Application Priority Data

Mar. 27, 2014 (JP) ..... 2014-066999

(51) Int. Cl.
*B24B 37/30* (2012.01)

(52) U.S. Cl.
CPC ..... *B24B 37/30* (2013.01)

(58) Field of Classification Search
CPC ..... B24B 37/30; B24B 49/16; B24B 37/04; B24B 41/061
USPC ..... 451/288
See application file for complete search history.

(56) References Cited

U.S. PATENT DOCUMENTS

| | | | | |
|---|---|---|---|---|
| 5,851,140 A * | 12/1998 | Barns | B24B 37/32 | 451/288 |
| 7,255,771 B2 * | 8/2007 | Chen | B24B 37/30 | 156/345.12 |
| 7,727,055 B2 | 6/2010 | Zuniga et al. | | |
| 7,950,985 B2 * | 5/2011 | Zuniga | B24B 37/30 | 428/119 |
| 7,959,496 B2 * | 6/2011 | Spiegel | B24B 37/30 | 451/288 |
| 8,475,231 B2 * | 7/2013 | Paik | B24B 37/30 | 451/288 |

FOREIGN PATENT DOCUMENTS

| | | | |
|---|---|---|---|
| JP | 2013-111679 | 6/2013 | |
| KR | 101196652 B1 * | 11/2012 | B24B 37/30 |
| WO | WO 02/07931 A2 | 1/2002 | |

* cited by examiner

*Primary Examiner* — George Nguyen
(74) *Attorney, Agent, or Firm* — Baker & Hostetler LLP

(57) ABSTRACT

An elastic membrane capable of precisely controlling a polishing profile in a narrow area of a wafer edge portion is disclosed. The elastic membrane includes a contact portion to be brought into contact with a substrate; a first edge circumferential wall extending upwardly from a peripheral edge of the contact portion; and a second edge circumferential wall having a horizontal portion connected to an inner circumferential surface of the first edge circumferential wall. The inner circumferential surface of the first edge circumferential wall includes an upper inner circumferential surface and a lower inner circumferential surface, both of which are perpendicular to the contact portion. The upper inner circumferential surface extends upwardly from the horizontal portion of the second edge circumferential wall, and the lower inner circumferential surface extends downwardly from the horizontal portion.

18 Claims, 8 Drawing Sheets

ELASTIC MEMBRANE, SUBSTRATE HOLDING APPARATUS, AND POLISHING APPARATUS

CROSS REFERENCE TO RELATED APPLICATION

This document claims priority to Japanese Patent Application Number 2014-066999 filed Mar. 27, 2014, the entire contents of which are hereby incorporated by reference.

BACKGROUND

With a recent trend toward higher integration and higher density in semiconductor devices, circuit interconnects become finer and finer and the number of levels in multilayer interconnect is increasing. In the fabrication process of the multilayer interconnects with finer circuit, as the number of interconnect levels increases, film coverage (or step coverage) of step geometry is lowered in thin film formation because surface steps grow while following surface irregularities on a lower layer. Therefore, in order to fabricate the multilayer interconnects, it is necessary to improve the step coverage and planarize the surface. It is also necessary to planarize semiconductor device surfaces so that irregularity steps formed thereon fall within a depth of focus in optical lithography. This is because finer optical lithography entails shallower depth of focus.

Accordingly, the planarization of the semiconductor device surfaces is becoming more important in the fabrication process of the semiconductor devices. Chemical mechanical polishing (CMP) is the most important technique in the surface planarization. This chemical mechanical polishing is a process of polishing a wafer by bringing the wafer into sliding contact with a polishing surface of a polishing pad while supplying a polishing liquid containing abrasive grains, such as silica ($SiO_2$), onto the polishing surface.

A polishing apparatus for performing CMP has a polishing table that supports the polishing pad thereon, and a substrate holding apparatus, which is called a top ring or a polishing bead, for holding a wafer. When the wafer is polished using such polishing apparatus, the substrate holding apparatus holds the wafer and presses it against the polishing surface of the polishing pad at a predetermined pressure, while the polishing table and the substrate holding apparatus are moved relative to each other to bring the wafer into sliding contact with the polishing surface to thereby polish a surface of the wafer.

During polishing of the wafer, if a relative pressing force applied between the wafer and the polishing surface of the polishing pad is not uniform over the entire surface of the wafer, insufficient polishing or excessive polishing would occur depending on a force applied to each portion of the wafer. Thus, in order to make the pressing force against the wafer uniform, the substrate holding apparatus has a pressure chamber defined by an elastic membrane at a lower part thereof. This pressure chamber is supplied with a fluid, such as air, to press the wafer through the elastic membrane with a fluid pressure.

However, since the above-described polishing pad has elasticity, the pressing force becomes non-uniform in an edge portion (or a peripheral portion) of the wafer during polishing of the wafer. Such non-uniform pressing force would result in so-called "rounded edge" which is excessive polishing that occurs only in the edge portion of the wafer. In order to prevent such rounded edge, a retaining ring for retaining the edge portion of the wafer is provided so as to be vertically movable relative to a top ring body (or carrier head body) and to press the polishing surface of the polishing pad around a circumferential edge of the wafer.

As the types of semiconductor devices have been increasing tremendously in recent years, there is an increasing demand for controlling a polishing profile in the wafer edge portion for each device or each CMP process (e.g., an oxide film polishing process and a metal film polishing process). One of the reasons is that each wafer has a different initial film-thickness distribution because a film-forming process, which is performed prior to the CMP process, varies depending on the type of film. Typically, a wafer is required to have a uniform film-thickness distribution over its entire surface after the CMP process. Therefore, different initial film-thickness distributions necessitate different polishing profiles.

Other reason is that types of polishing pads and polishing liquids, both of which are consumables of the polishing apparatus, are increasing greatly from a viewpoint of costs. Use of different polishing pads or different polishing liquids results in greatly different polishing profiles particularly in the wafer edge portion. In a semiconductor device fabrication, the polishing profile in the wafer edge portion can greatly affect a product yield. Therefore, it is very important to precisely control the polishing profile of the wafer edge portion, particularly in a narrow area of the wafer edge portion in a radial direction.

In order to control the polishing profile of the wafer edge portion, various elastic membranes as disclosed in Japanese laid-open patent publication No. 2013-111679 have been proposed. However, these elastic membranes are suitable for controlling the polishing profile in a relatively wide area of the wafer edge portion.

SUMMARY OF THE INVENTION

According to an embodiment, there is provided an elastic membrane (or a membrane) capable of precisely controlling a polishing profile in a narrow area of a wafer edge portion. Further, there is provided a substrate holding apparatus and a polishing apparatus having such an elastic membrane.

Embodiments, which will be described below, relate to an elastic membrane for use in a substrate holding apparatus for holding a substrate, such as a wafer. Further, the embodiments relate to a substrate holding apparatus and a polishing apparatus having such an elastic membrane.

In an embodiment, there is provided an elastic membrane for use in a substrate holding apparatus, comprising: a contact portion to be brought into contact with a substrate for pressing the substrate against a polishing pad; a first edge circumferential wall extending upwardly from a peripheral edge of the contact portion; and a second edge circumferential wall having a horizontal portion connected to an inner circumferential surface of the first edge circumferential wall, wherein the inner circumferential surface of the first edge circumferential wall includes an upper inner circumferential surface and a lower inner circumferential surface, both of which are perpendicular to the contact portion, the upper inner circumferential surface extends upwardly from the horizontal portion of the second edge circumferential wall, and the lower inner circumferential surface extends downwardly from the horizontal portion of the second edge peripheral wall.

In an embodiment, the upper inner circumferential surface and the lower inner circumferential surface lie in a same plane.

In an embodiment, an annular groove extending in a circumferential direction of the first edge circumferential wall is formed in the lower inner circumferential surface.

In an embodiment, the annular groove is located at a lower end of the lower inner circumferential surface.

In an embodiment, the elastic membrane further comprises a third edge circumferential wall located radially inwardly of the second edge circumferential wall, the third edge circumferential wall having a lower end connected to the contact portion, the lower end of the third edge circumferential wall being located adjacent to the first edge circumferential wall.

In an embodiment, there is provided a substrate holding apparatus comprising: an elastic membrane that forms pressure chambers for pressing a substrate; a head body to which the elastic membrane 5 secured; and a retaining ring surrounding the elastic membrane, wherein the elastic membrane comprises (i) a contact portion to be brought into contact with the substrate for pressing the substrate against a polishing pad, (ii) a first edge circumferential wall extending upwardly from a peripheral edge of the contact portion, and (iii) a second edge circumferential wall having a horizontal portion connected to an inner circumferential surface of the first edge circumferential wall. The inner circumferential surface of the first edge circumferential wall includes an upper inner circumferential surface and a lower inner circumferential surface, both of which are perpendicular to the contact portion, the upper inner circumferential surface extends upwardly from the horizontal portion of the second edge circumferential wall, and the lower inner circumferential surface extends downwardly from the horizontal portion of the second edge peripheral wall.

In an embodiment, there is provided a polishing apparatus comprising: a polishing table for supporting a polishing pad; and a substrate holding apparatus configured to press a substrate against the polishing pad, the substrate holding apparatus including an elastic membrane that forms pressure chambers for pressing the substrate, a head body to which the elastic membrane is secured, and a retaining ring surrounding the elastic membrane, wherein the elastic membrane comprises (i) a contact portion to be brought into contact with the substrate for pressing the substrate against the polishing pad, (ii) a first edge circumferential wall extending upwardly from a peripheral edge of the contact portion, and (iii) a second edge circumferential wall having a horizontal portion connected to an inner circumferential surface of the first edge circumferential wall. The inner circumferential surface of the first edge circumferential wall includes an upper inner circumferential surface and a lower inner circumferential surface, both of which are perpendicular to the contact portion, the upper inner circumferential surface extends upwardly from the horizontal portion of the second edge circumferential wall, and the lower inner circumferential surface extends downwardly from the horizontal portion of the second edge peripheral wall.

Use of the above-described elastic membrane in the substrate holding apparatus of the polishing apparatus makes it possible to precisely control a polishing rate in a narrow area of a periphery portion of the substrate. Therefore, a uniformity of the polishing rate over the substrate surface is improved in various types of processes, and as a result, a product yield can be improved.

DESCRIPTION OF EMBODIMENTS

Figure 1:
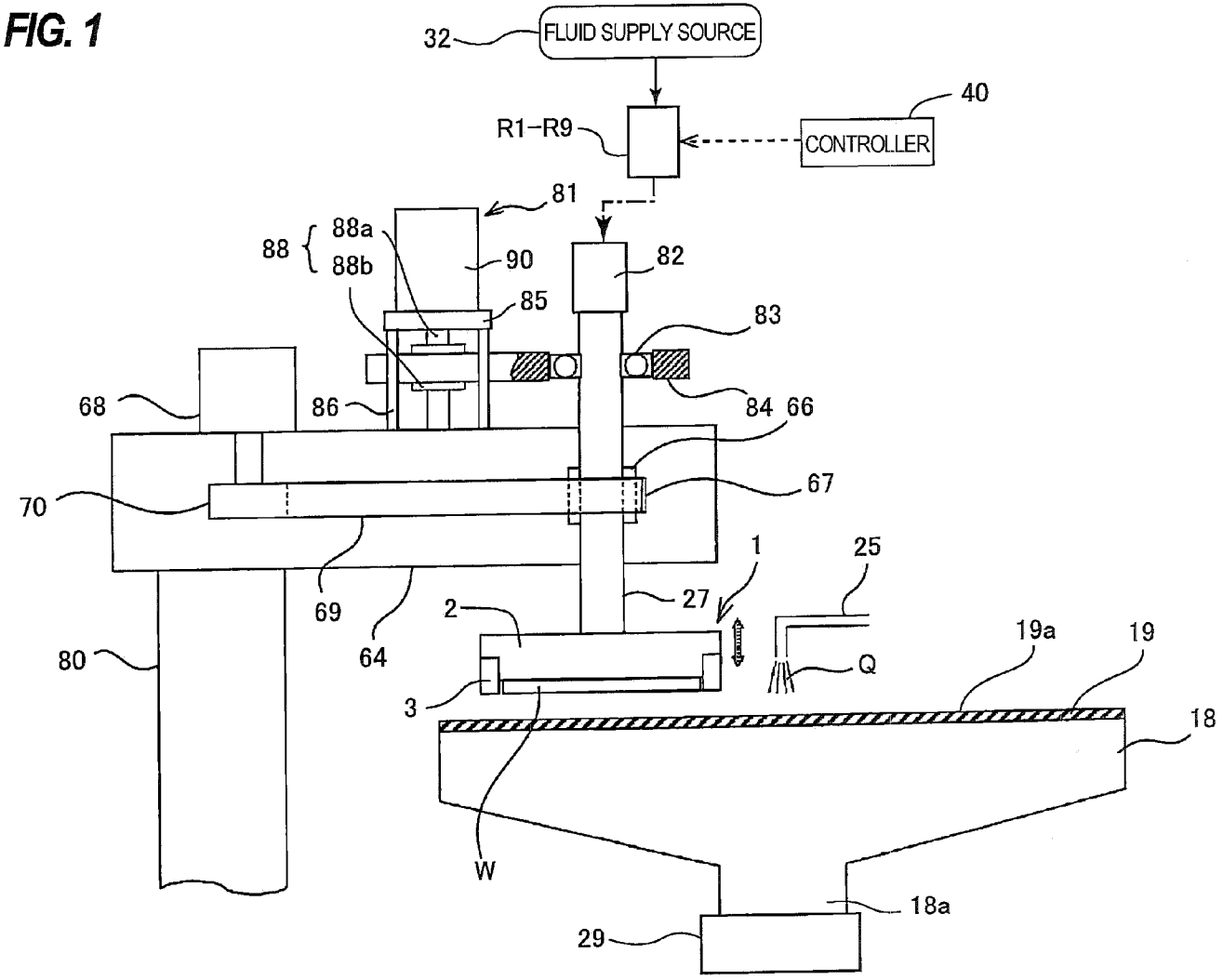
FIG. 1 is a view showing a polishing apparatus according to an embodiment.

Embodiments will be described below with reference to the drawings. FIG. 1 is a view showing a polishing apparatus according to an embodiment. As shown in FIG. 1, the polishing apparatus includes a polishing table 18 for supporting a polishing pad 19, and a polishing head (or a substrate holding apparatus) 1 for holding a wafer W as an example of a substrate, which is an object to be polished, and pressing the wafer W against the polishing pad 19 on the polishing table 18.

The polishing table 18 is coupled via a table shaft 18*a* to a table motor 29 disposed below the polishing table 18, so that the polishing table 18 is rotatable about the table shaft 18*a*. The polishing pad 19 is attached to an upper surface of the polishing table 18. A surface 19*a* of the polishing pad 19 serves as a polishing surface for polishing the wafer W. A polishing liquid supply nozzle 25 is provided above the polishing table 18 so that the polishing liquid supply nozzle 25 supplies a polishing liquid Q onto the polishing pad 19 on the polishing table 18.

The polishing head 1 includes a head body 2 for pressing the wafer W against the polishing surface 19*a*, and a retaining ring 3 for retaining the wafer W therein so as to prevent the wafer W from slipping out of the polishing head 1. The polishing head 1 is coupled to a head shaft 27, which is vertically movable relative to a head arm 64 by a vertically moving mechanism 81. This vertical movement of the head shaft 27 causes the entirety of the polishing head 1 to move upward and downward relative to the head arm 64 for positioning of the polishing head 1 and enables positioning of the polishing head 1. A rotary joint 82 is mounted to an upper end of the head shaft 27.

The vertically moving mechanism 81 for elevating and lowering the head shaft 27 and the polishing head 1 includes a bridge 84 that rotatably supports the head shaft 27 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the head arm 64 through the support posts 86.

The ball screw 88 includes a screw shaft 88*a* coupled to the servomotor 90 and a nut 88*b* that engages with the screw shaft 88*a*. The head shaft 27 is vertically movable together with the bridge 84. When the servomotor 90 is set in motion, the bridge 84 moves vertically through the ball screw 88, so that the head shaft 27 and the polishing head 1 move vertically.

The head shaft 27 is coupled to a rotary sleeve 66 by a key (not shown). A timing pulley 67 is secured to a circumferential surface of the rotary sleeve 66. A head motor 68 is fixed to the head arm 64. The timing pulley 67 is coupled through a timing belt 69 to a timing pulley 70, which is mounted to the head motor 68. When the head motor 68 is set in motion, the rotary sleeve 66 and the head shaft 27 are rotated together with the timing pulley 70, the timing belt 69, and the timing pulley 67, thus rotating the polishing head 1. The head arm 64 is supported by an arm shaft 80, which is rotatably supported by a frame (not shown). The polishing apparatus includes a controller 40 for controlling devices including the head motor 68 and the servomotor 90.

The polishing head 1 is configured to be able to hold the wafer W on its lower surface. The head arm 64 is configured to be able to pivot on the arm shaft 80. Thus, the polishing head 1, when holding the wafer W on its lower surface, is moved from a position at which the polishing head 1 receives the wafer W to a position above the polishing table 18 by a pivotal movement of the head arm 64.

Polishing of the wafer W is performed as follows. The polishing head 1 and the polishing table 18 are rotated individually, while the polishing liquid Q is supplied from the polishing liquid supply nozzle 25, located above the polishing table 18, onto the polishing pad 19. In this state, the polishing head 1 is lowered to a predetermined position (i.e., a predetermined height) and then presses the wafer W against the polishing surface 19*a* of the polishing pad 19. The wafer W is placed in sliding contact with the polishing surface 19*a* of the polishing pad 19, so that a surface of the wafer W is polished.

Figure 2:
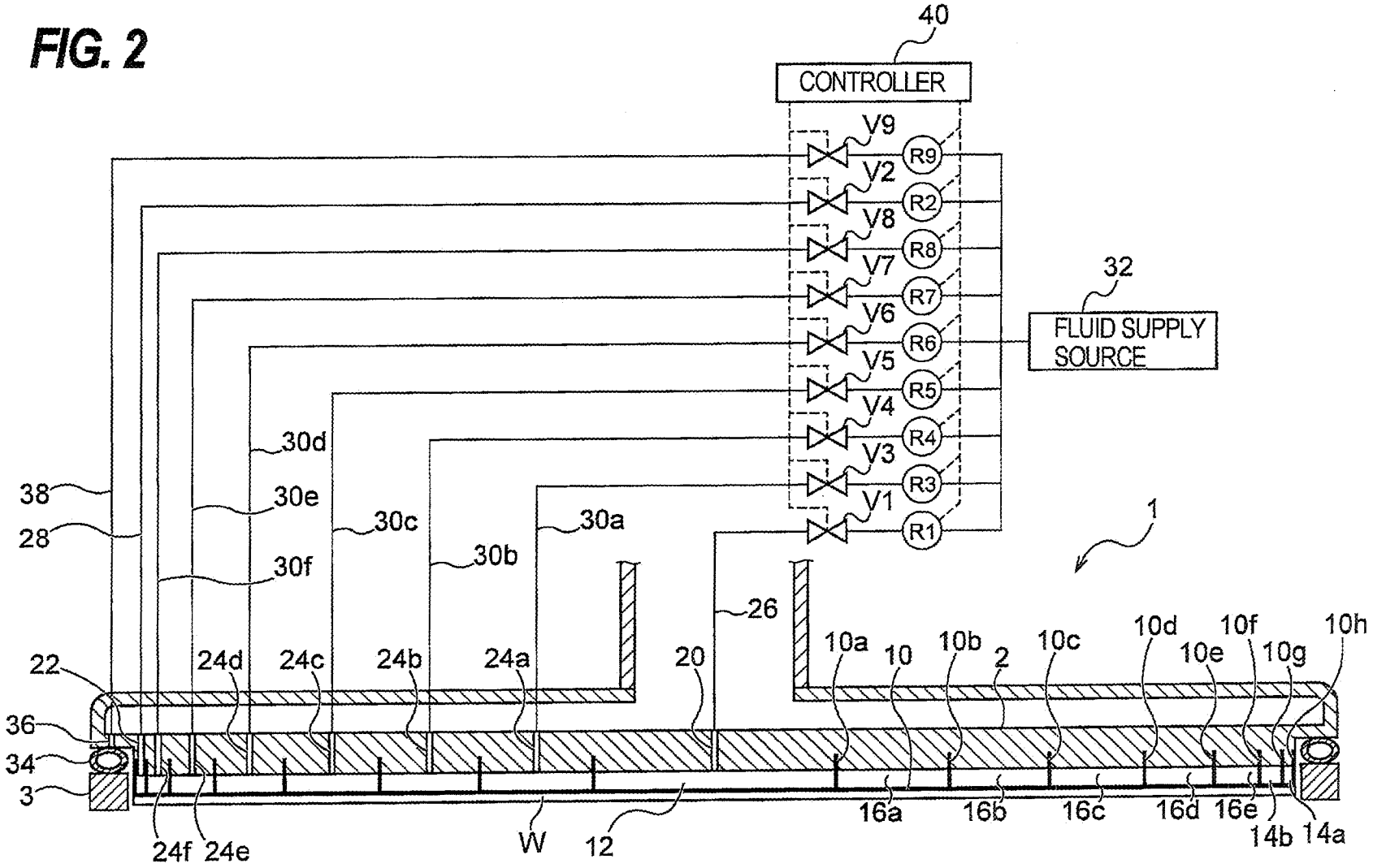
FIG. 2 is a view showing a polishing head (or a substrate holding apparatus) incorporated in the polishing apparatus shown in FIG. 1.

Next, the polishing head (substrate holding apparatus) 1, which is installed in the polishing apparatus shown in FIG. 1, will be described in detail with reference to FIG. 2. As shown in FIG. 2, the polishing head 1 includes the head body 2 which is secured to a lower end of the head shaft 27, the retaining ring 3 for directly pressing the polishing surface 19*a*, and a flexible elastic membrane 10 for pressing the wafer W against the polishing surface 19*a*. The retaining ring 3 is disposed so as to surround the wafer W and the elastic membrane 10, and is coupled to the head body 2. The elastic membrane 10 is attached to the head body 2 so as to cover a lower surface of the head body 2.

The elastic membrane 10 has a plurality of (eight in the drawing) annular circumferential walls 10*a*, 10*b*, 10*c*, 10*d*, 10*e*, 10*f*, 10*g*, and 10*h*, which are arranged concentrically. These circumferential walls 10*a*, 10*b*, 10*c*, 10*d*, 10*e*, 10*f*, 10*g*, and 10*h* form a circular central pressure chamber 12 located at a center of the elastic membrane 10, annular edge pressure chambers 14*a*, 14*b* located at the outermost part of the elastic membrane 10, and five (in this embodiment) annular intermediate pressure chambers (i.e., first to fifth intermediate pressure chambers) 16*a*, 16*b*, 16*c*, 16*d*, and 16*e* located between the central pressure chamber 12 and the edge pressure chambers 14*a*, 14*b*. These pressure chambers 12, 14*a*, 14*b*, 16*a*, 16*b*, 16*c*, 16*d*, and 16*e* are located between an upper surface of the elastic membrane 10 and the lower surface of the head body 2.

The head body 2 has a fluid passage 20 communicating with the central pressure chamber 12, a fluid passage 22 communicating with the edge pressure chamber 14*a*, a fluid passage 24*f* communicating with the edge pressure chamber 14*b*, and fluid passages 24*a*, 24*b*, 24*c*, 24*d*, and 24*e* communicating with the intermediate pressure chambers 16*a*, 16*b*, 16*c*, 16*d*, and 16*e*, respectively. These fluid passages 20, 22, 24*a*, 24*b*, 24*c*, 24*d*, 24*e*, and 24*f* are coupled to fluid lines 26, 28, 30*a*, 30*b*, 30*c*, 30*d*, 30*e*, and 30*f*, respectively, all of which are coupled to a fluid supply source 32. The fluid lines 26, 28, 30*a*, 30*b*, 30*c*, 30*d*, 30*e*, and 30*f* are provided with on-off valves V1, V2, V3, V4, V5, V6, V7, and V8 and pressure regulators R1, R2, R3, R4, R5, R6, R7, and R8, respectively.

A retainer chamber 34 is formed immediately above the retaining ring 3. This retainer chamber 34 is coupled via a fluid passage 36 and a fluid line 38 to the fluid supply source 32. The fluid passage 36 is formed in the head body 2. The fluid line 38 is provided with an on-off valve V9 and a pressure regulator R9. The pressure regulators R1, R2, R3, R4, R5, R6, R7, R8, and R9 have pressure regulating function to regulate pressure of the pressurized fluid supplied from the fluid supply source 32 to the respective pressure chambers 12, 14*a*, 14*b*, 16*a*, 16*b*, 16*c*, 16*d*, and 16*e*, and the retainer chamber 34. The pressure regulators R1 to R9 and the on-off valves V1 to V9 are coupled to the controller 40, so that operations of the pressure regulators R1 to R9 and the on-off valves V1 to V9 are controlled by the controller 40.

According to the polishing head 1 configured as shown in FIG. 2, pressures of the pressurized fluid supplied to the pressure chambers 12, 14*a*, 14*b*, 16*a*, 16*b*, 16*c*, 16*d*, and 16*e* are controlled while the wafer W is held on the polishing head 1, so that the polishing head 1 can press the wafer W with different pressures that are transmitted through multiple areas of the elastic membrane 10 arrayed along a radial direction of the wafer W. Thus, in the polishing head 1, pressing forces applied to the wafer W can be adjusted at multiple zones of the wafer W by adjusting pressures of the pressurized fluid supplied to the respective pressure chambers 12, 14*a*, 14*b*, 16*a*, 16*b*, 16*c*, 16*d*, and 16*e* defined between the head body 2 and the elastic membrane 10. At the same time, a pressing force for pressing the polishing pad 19 by the retaining ring 3 can be adjusted by regulating pressure of the pressurized fluid supplied to the retainer chamber 34.

The head body 2 is made of resin, such as engineering plastic (e.g., PEEK), and the elastic membrane 10 is made of a highly strong and durable rubber material, such as ethylene propylene rubber (EPDM), polyurethane rubber, silicone rubber, or the like.

Figure 3:
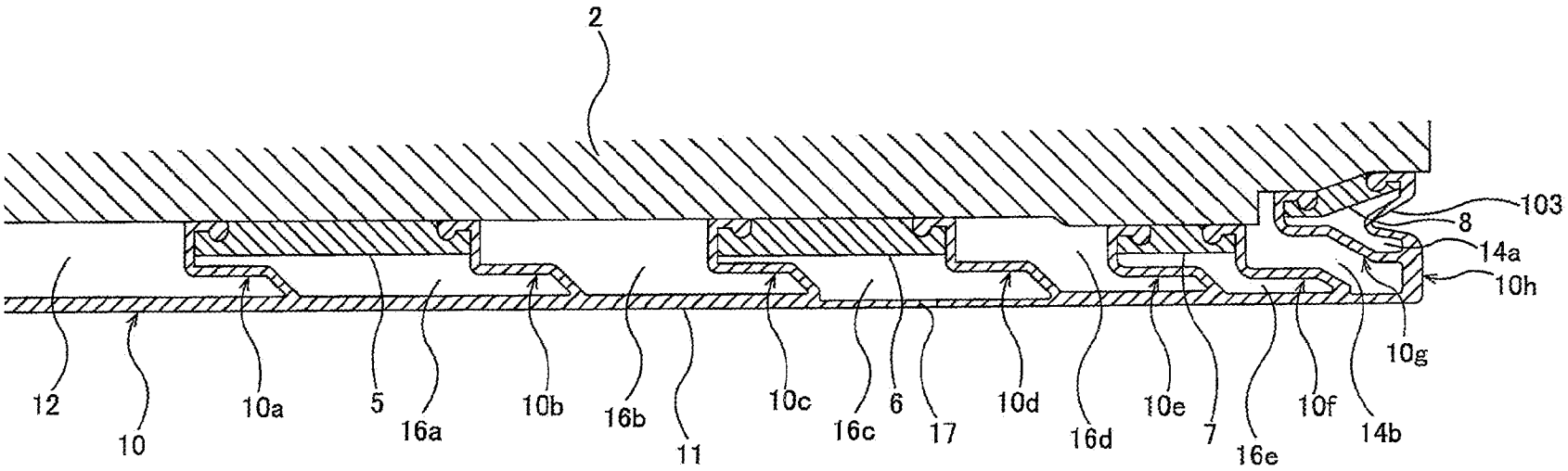
FIG. 3 is a cross-sectional view showing an elastic membrane (or a membrane) installed in the polishing head shown in FIG. 2.

FIG. 3 is a cross-sectional view showing the elastic membrane (or the membrane) 10. The elastic membrane 10 has a circular contact portion 11 that can be brought into contact with the wafer W, and the eight circumferential walls 10*a*, 10*b*, 10*c*, 10*d*, 10*e*, 10*f*, 10*g* and 10*b* which are directly or indirectly coupled to the contact portion 11. The contact portion 11 is brought into contact with a rear surface of the wafer W, which is a surface at an opposite side of a surface to be polished, to press the wafer W against the polishing pad 19. The circumferential walls 10*a*, 10*b*, 10*e*, 10*d*, 10*e*, 10*f*, 10*g*, and 10*h* are annular circumferential walls arranged concentrically.

Upper ends of the circumferential walls 10*a* to 10*h* are attached to a lower surface of the head body 2 by four holding rings 5, 6, 7, and 8. These holding rings 5, 6, 7, and 8 are removably secured to the head body 2 by holding devices (not shown). Therefore, when the holding devices are removed, the holding rings 5, 6, 7, and 8 are separated from the head body 2, thereby allowing the elastic membrane 10 to be removed from the head body 2. The holding devices may be screws.

The contact portion 11 has a plurality of through-holes 17 communicating with the intermediate pressure chamber 16*c*. Only one through-hole 17 is shown in FIG. 3. When a vacuum is produced in the intermediate pressure chamber 16*c* with the wafer W in contact with the contact portion 11, the wafer W is held on a lower surface of the contact portion 11 (i.e., the polishing head 1) by a vacuum suction. Further, when the pressurized fluid is supplied into the intermediate pressure chamber 16*c* with the wafer W separated from the polishing pad 19, the wafer W is released from the polishing head 1. The through-holes 17 may be formed at another pressure chamber, instead of the intermediate pressure chamber 16*c*. In such case, the vacuum suction and the release of the wafer W are performed by controlling pressure in the pressure chamber at which the through-holes 17 are formed.

The circumferential wall 10*h* is an outermost circumferential wall, and the circumferential wall 10*g* is located radially inwardly of the circumferential wall 10*h*. Further, the circumferential wall 10*f* is located radially inwardly of the circumferential wall 10*g*. Hereinafter, the circumferential wall 10*h* will be referred to as first edge circumferential wall, the circumferential wall 10*g* will be referred to as second edge circumferential wall, and the circumferential wall 10*f* will be referred to as third edge circumferential wall.

Figure 4:
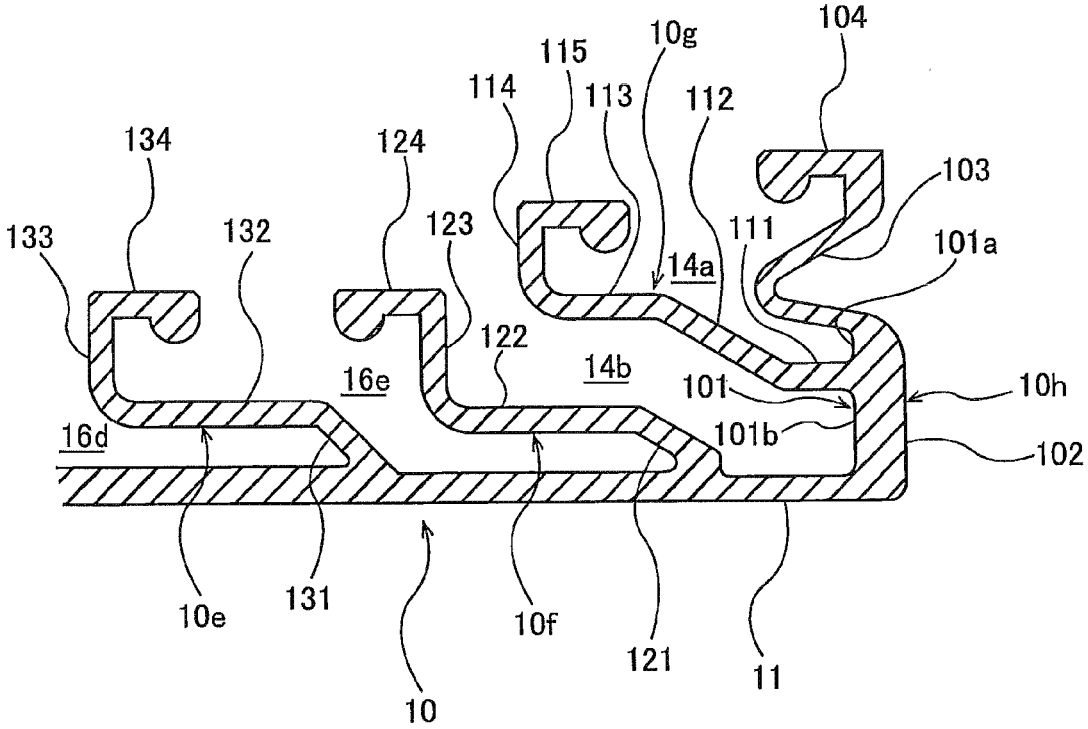
FIG. 4 is an enlarged cross-sectional view showing a part of the elastic membrane.
Figure 5:
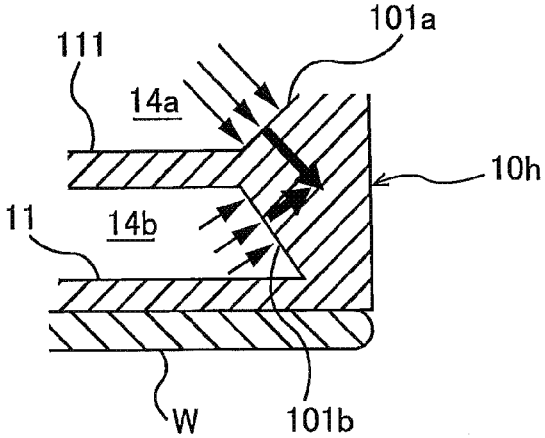
FIG. 5 is a view illustrating directions of forces in a case where an upper inner circumferential surface and a lower inner circumferential surface of a first edge circumferential wall are inclined.
Figure 6:
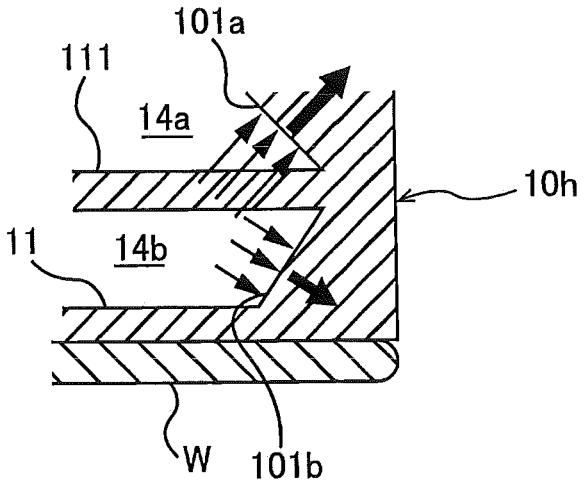
FIG. 6 is a view illustrating directions of forces in a case where an upper inner circumferential surface and a lower inner circumferential surface of a first edge circumferential wall are inclined.
Figure 7:
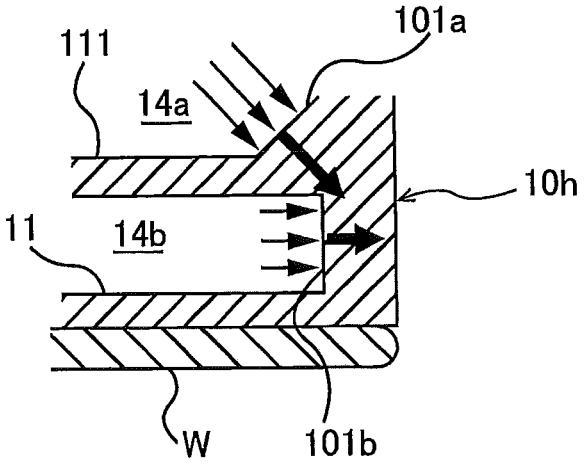
FIG. 7 is a view illustrating directions of forces in a case where an upper inner circumferential surface of a first edge circumferential wall is inclined.
Figure 8:
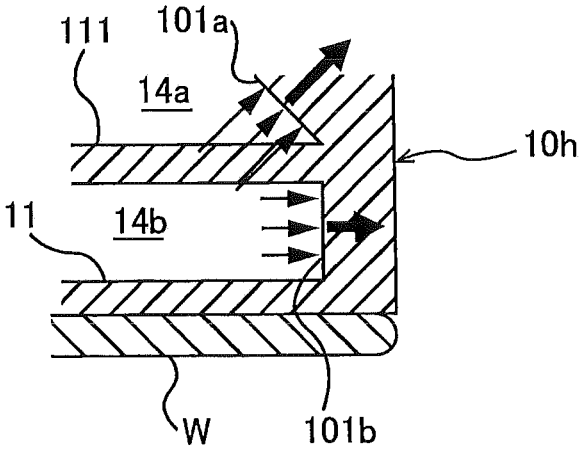
FIG. 8 is a view illustrating directions of forces in a case where a lower inner circumferential surface of a first edge circumferential wall is inclined.

FIG. 4 is an enlarged cross-sectional view showing a part of the elastic membrane 10. In order to make it possible to control a polishing rate in a narrow area of an edge portion of the wafer W, the elastic membrane 10 has a configuration shown in FIG. 4. The elastic membrane 10 will now be described in detail. The first edge circumferential wall 10*h* extends upwardly from a peripheral edge of the contact portion 11, and the second edge circumferential wall 10*g* is connected to the first edge circumferential wall 10*h*.

The second edge circumferential wall 10*g* has an outer horizontal portion 111 which is connected to an inner circumferential surface 101 of the first edge circumferential wall 10*h*. The inner circumferential surface 101 of the first edge circumferential wall 10*h* includes an upper inner circumferential surface 101*a* and a lower inner circumferential surface 101*b*, both of which are perpendicular to the contact portion 11. The upper inner circumferential surface 101*a* extends upwardly from the horizontal portion 111 of the second edge circumferential wall 10*g*, and the lower inner circumferential surface 101*b* extends downwardly from the horizontal portion 111 of the second edge circumferential wall 10*g*. In other words, the outer horizontal portion 11*l* of the second edge circumferential wall 10*g* is connected to a position at which the inner circumferential surface 101, extending in a direction perpendicular to the contact portion 11, is divided. The lower inner circumferential surface 101*b* is connected to the peripheral edge of the contact portion 11. An outer circumferential surface 102, located outside the lower inner circumferential surface 10*b*, are also perpendicular to the contact portion 11. The upper inner circumferential surface 101*a* and the lower inner circumferential surface 101*b* lie in the same plane. This "same plane" is an imaginary plane that is perpendicular to the contact portion 11. Thus, a radial position of the upper inner circumferential surface 101*a* is the same as a radial position of the lower inner circumferential surface 101*b*.

The first edge circumferential wall 10*h* includes a fold portion 103 that allows the contact portion 11 to move upward and downward. This fold portion 103 is connected to the upper inner circumferential surface 101*a*. The fold portion 103 has a bellows structure that can expand and contract in the direction perpendicular to the contact portion 11 (i.e., in vertical direction). Therefore, even if a distance between the head body 2 and the polishing pad 19 changes, the contact between the peripheral edge of the contact portion 11 and the wafer W can be maintained. Causes of the change in the distance between the head body 2 and the polishing pad 19 include an inclination of the head body 2 and the polishing pad 19 relative to each other, an oscillation of the polishing pad surface 19*a* with the rotation of the polishing table 18, and an axial oscillation (an oscillation in the vertical direction) with the rotation of the head shaft 27. The first edge circumferential wall 10*h* has a rim portion 104 extending radially inwardly from an upper end of the fold portion 103. The rim portion 104 is secured to the lower surface of the head body 2 by the holding ring 8 shown in FIG. 3.

The second edge circumferential wall 10*g* has the outer horizontal portion 111 extending horizontally from the inner circumferential surface 101 of the first edge circumferential wall 10*h*. Further, the second circumferential wall 10*g* has a slope portion 112 connected to the outer horizontal portion 111, an inner horizontal portion 113 connected to the slope portion 112, a vertical portion 114 connected to the inner horizontal portion 113, and a rim portion 115 connected to the vertical portion 114. The slope portion 112 extends radially inwardly from the outer horizontal portion 111 while sloping upwardly. The rim portion 115 extends radially outwardly from the vertical portion 114, and is secured to the lower surface of the head body 2 by the holding ring 8 shown in FIG. 3. When the first edge circumferential wall 10*h* and the second edge circumferential wall 10*g* are secured to the lower surface of the head body 2 by the holding ring 8, the edge pressure chamber 14*a* is formed between the first edge circumferential wall 10*b* and the second edge circumferential wall 10*g*.

The third edge circumferential wall 10*f* is located radially inwardly of the second edge circumferential wall 10*g*. The third edge circumferential wall 10*f* has a slope portion 121 connected to an upper surface of the contact portion 11, a horizontal portion 122 connected to the slope portion 121, a vertical portion 123 connected to the horizontal portion 122, and a rim portion 124 connected to the vertical portion 123. The slope portion 121 extends radially inwardly from the upper surface of the contact portion 11 while sloping upwardly. The rim portion 124 extends radially inwardly from the vertical portion 123, and is secured to the lower surface of the head body 2 by the holding ring 7 shown in FIG. 3. When the second edge circumferential wall 10*g* and the third edge circumferential wall 10*f* are secured to the lower surface of the head body 2 by the holding rings 8, 7, respectively, the edge pressure chamber 14*b* is formed between the second edge circumferential wall 10*g* and the third edge circumferential wall 10*f*.

The circumferential wall 10*c* is located radially inwardly of the third edge circumferential wall 10*f*. The circumferential wall 10*e* has a slope portion 131 connected to the upper surface of the contact portion 11, a horizontal portion 132 connected to the slope portion 131, a vertical portion 133 connected to the horizontal portion 132, and a rim portion 134 connected to the vertical portion 133. The slope portion 131 extends radially inwardly from the upper surface of the contact portion 11 while sloping upwardly. The rim portion 134 extends radially outwardly from the vertical portion 133, and is secured to the lower surface of the head body 2 by the holding ring 7 shown in FIG. 3. When the circumferential wall 10*e* and the third edge circumferential wall 10*f* are secured to the lower surface of the head body 2 by the holding ring 7, the intermediate pressure chamber 16*e* is formed between the circumferential wall 10*e* and the third edge circumferential wall 10*f*.

The circumferential walls 10*b*, 10*d* shown in FIG. 3 have substantially the same structures as those of the third edge circumferential wall 10*f* shown in FIG. 4, and the circumferential walls 10*a*, 10*c* shown in FIG. 3 have substantially the same structures as those of the circumferential wall 10*e* shown in FIG. 4. Therefore, repetitive descriptions of the circumferential walls 10*b*, 10*d*, 10*a*, 10*c* are omitted. As shown in FIG. 3, rim portions of the circumferential walls 10*e*, 10*b* are secured to the lower surface of the head body 2 by the holding ring 5, and rim portions of the circumferential walls 10*c*, 10*d* are secured to the lower surface of the head body 2 by the holding ring 6.

As shown in FIG. 4, the edge pressure chamber 14*a* is located above the edge pressure chamber 14*b*. The edge pressure chamber 14*a* and the edge pressure chamber 14*b* are partitioned from each other by the second edge circumferential wall 10*g* that extends approximately in the horizontal direction. Since the second edge circumferential wall 10*g* is connected to the first edge circumferential wall 10*h*, a differential pressure between the edge pressure chamber 14*a* and the edge pressure chamber 14*b* generates a downward force that pushes down the first edge circumferential wall 10*h* in the vertical direction. More specifically, when the pressure in the edge pressure chamber 14*a* is larger than the pressure in the edge pressure chamber 14*b*, the differential pressure between the edge pressure chamber 14*a* and the edge pressure chamber 14*b* generates the downward force in the first edge circumferential wall 10*h*, so that the first edge circumferential wall 10*h* presses the peripheral edge of the contact portion 11 in the vertical direction against the rear surface of the wafer W. As a result, the peripheral edge of the contact portion 11 presses the wafer edge portion against the polishing pad 19. In this manner, since the downward force acts on the first edge circumferential wall 10*h* itself in the vertical direction, the peripheral edge of the contact portion 11 can press a narrow area in the wafer edge portion against the polishing pad 19. Therefore, a polishing profile in the wafer edge portion can be precisely controlled.

The upper inner circumferential surface 101*a* extends upwardly in the direction perpendicular to the contact portion 11, and the lower inner circumferential surface 101*b* extends downwardly in the direction perpendicular to the contact portion 11. Because of such configurations of the upper inner circumferential surface 101*a* and the lower inner circumferential surface 101*b*, an oblique force is not applied to a connecting portion between the first edge circumferential wall 10*h* and the second edge circumferential wall 10*g*, and as a result, the polishing rate can be controlled in a narrow area of the wafer edge portion. This feature will be described below with reference to FIGS. 5 through 9.

As shown in FIGS. 5 through 8, if the upper inner circumferential wall 101*a* and/or the lower inner circumferential surface 101*b* slope, an oblique force is applied to the connecting portion between the first edge circumferential wall 10*h* and the second edge circumferential wall 10*g*. As a result, a force is applied to a wide area in a connecting portion between the first edge circumferential wall 10*h* and the contact portion 11, thus hindering the controlling of the polishing rate in the narrow area of the wafer edge portion. Moreover, when the differential pressure between the edge pressure chamber 14*a* and the edge pressure chamber 14*b* is generated, an oblique force is applied to the connecting portion between the first edge circumferential wall 10*h* and the second edge circumferential wall 10*g*, thus causing deformation or collapse of the first edge circumferential wall 10*h*. As a result, a force cannot be transmitted to the wafer W.

Figure 9:
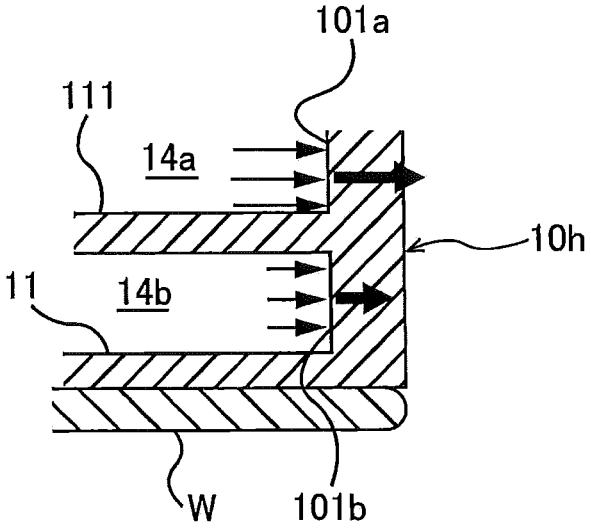
FIG. 9 is a view illustrating directions of forces in a case where an upper inner circumferential surface and a lower inner circumferential surface of a first edge circumferential wall are perpendicular to a contact portion.

In contrast, as shown in FIG. 9 according to this embodiment, both of the upper inner circumferential surface 101*a* and the lower inner circumferential surface 101*b* extend in the vertical direction, i.e., in the direction perpendicular to the contact portion 11. With these configurations, an oblique force is hardly applied to the connecting portion between the first edge circumferential wall 10*h* and the second edge circumferential wall 10*g*. Moreover, the downward force, generated by the differential pressure between the edge pressure chamber 14*a* and the edge pressure chamber 14*b*, is transmitted through the first edge circumferential wall 10*h*, thus acting in the vertical direction on the wafer edge portion. Therefore, the polishing rate can be controlled in a narrow area of the wafer edge portion.

Figure 10:
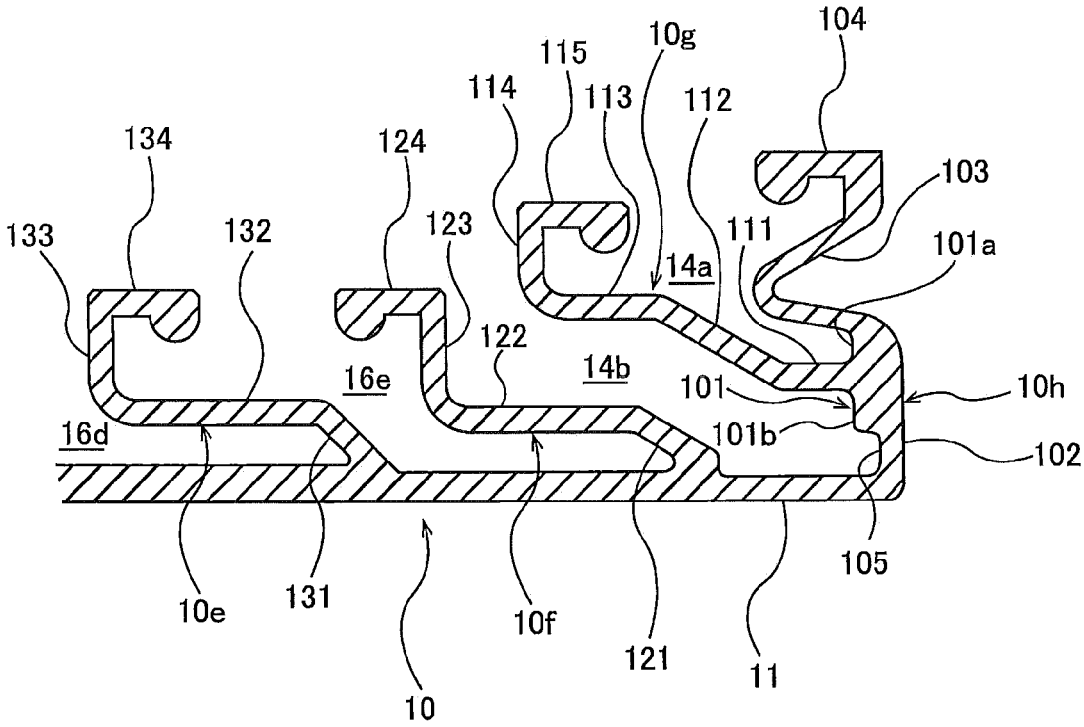
FIG. 10 is a cross-sectional view showing the elastic membrane according to another embodiment.

FIG. 10 is a cross-sectional view showing the elastic membrane 10 according to another embodiment. Structures that are not described particularly in this embodiment are identical to those of the embodiment shown in FIG. 4. As shown in FIG. 10, an annular groove 105 extending in a circumferential direction of the first edge circumferential wall 10*h* is formed in the lower inner circumferential surface 101*b*. This annular groove 105 is located at a lower end of the lower inner circumferential surface 101*b* to form a thin portion in the first edge circumferential wall 10*h*. With this annular groove 105 located adjacent to the contact portion 11, even if an oblique force is applied to the first edge circumferential wall 10*h*, such an oblique force is less likely to be transmitted to the contact portion 11. Therefore, the polishing rate can be controlled in a narrow area of the wafer edge portion.

Figure 11:
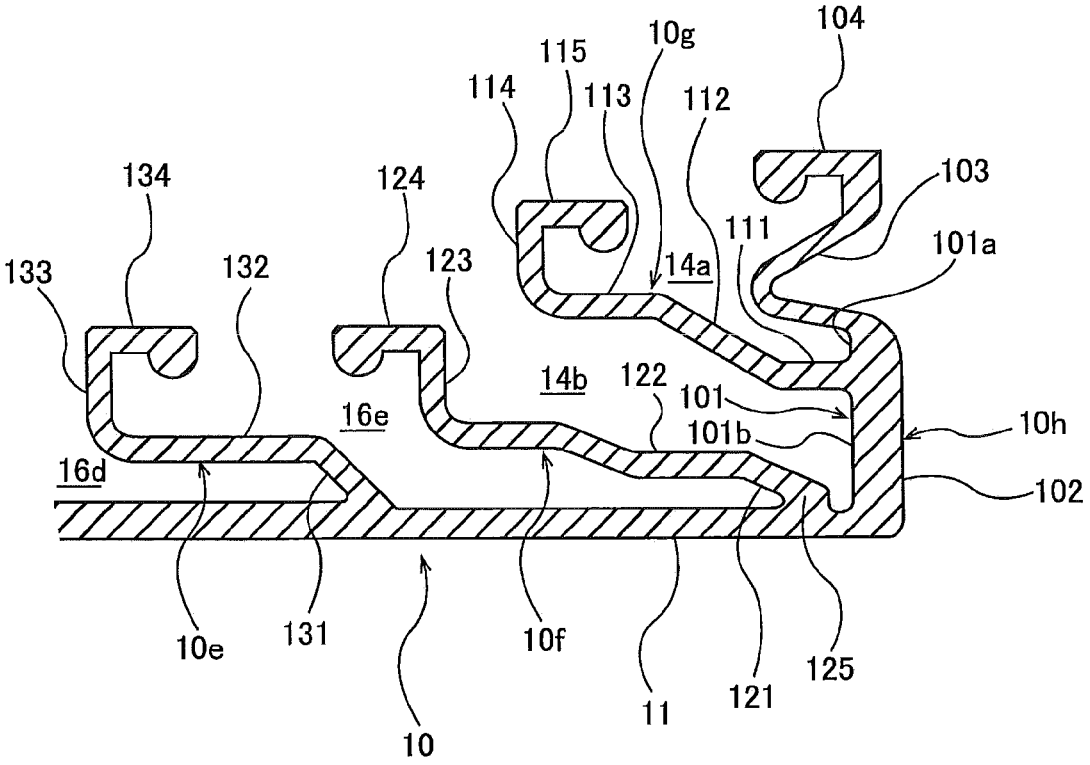
FIG. 11 is a cross-sectional view showing the elastic membrane according to still another embodiment.

FIG. 11 is a cross-sectional view showing the elastic membrane 10 according to still another embodiment. Structures that are not described particularly in this embodiment are identical to those of the embodiment shown in FIG. 4. As shown in FIG. 11, a lower end 125 of the third edge circumferential wall 10*f* is located adjacent to the first edge circumferential wall 10*h*. For example, a distance between the lower end 125 of the third edge circumferential wall 10*f* and the lower inner circumferential surface 101*b* of the first edge circumferential wall 10*h* is in a range of 1 mm to 10 mm, more preferably in a range of 1 mm to 5 mm. According to this configuration of the embodiment, the pressure in the edge pressure chamber 14*b* can be applied to a narrower area of the contact portion 11. Therefore, the polishing rate can be controlled in a narrow area of the wafer edge portion.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. An elastic membrane for use in a substrate holding apparatus, comprising:

a contact portion to be brought into contact with a substrate for pressing the substrate against a polishing pad;

a first edge circumferential wall extending upwardly from a peripheral edge of the contact portion; and a second edge circumferential wall having a horizontal portion connected to an inner circumferential surface of the first edge circumferential wall, wherein the inner circumferential surface of the first edge circumferential wall includes an upper inner circumferential surface and a lower inner circumferential surface, both of which are perpendicular to the contact portion, the upper inner circumferential surface and an upper surface of the horizontal portion defining a first edge pressure chamber, and the lower inner circumferential surface and a lower surface of the horizontal portion defining a second edge pressure chamber located below the first edge pressure chamber, the upper inner circumferential surface extends upwardly from the horizontal portion of the second edge circumferential wall, and the lower inner circumferential surface extends downwardly from the horizontal portion of the second edge peripheral wall.

2. The elastic membrane according to claim 1, wherein the upper inner circumferential surface and the lower inner circumferential surface lie in a same plane.

3. The elastic membrane according to claim 1, wherein an annular groove extending in a circumferential direction of the first edge circumferential wall is formed in the lower inner circumferential surface.

4. The elastic membrane according to claim 3, wherein the annular groove is located at a lower end of the lower inner circumferential surface.

5. The elastic membrane according to claim 1, further comprising:

a third edge circumferential wall located radially inwardly of the second edge circumferential wall, the third edge circumferential wall having a lower end connected to the contact portion, the lower end of the third edge circumferential wall being located adjacent to the first edge circumferential wall.

6. A substrate holding apparatus comprising:

an elastic membrane that forms pressure chambers for pressing a substrate;

a head body to which the elastic membrane is secured; and a retaining ring surrounding the elastic membrane, wherein the elastic membrane comprises (i) a contact portion to be brought into contact with the substrate for pressing the substrate against a polishing pad, (ii) a first edge circumferential wall extending upwardly from a peripheral edge of the contact portion, and (iii) a second edge circumferential wall having a horizontal portion connected to an inner circumferential surface of the first edge circumferential wall, the inner circumferential surface of the first edge circumferential wall includes an upper inner circumferential surface and a lower inner circumferential surface, both of which are perpendicular to the contact portion, the upper inner circumferential surface and an upper surface of the horizontal portion defining a first edge pressure chamber, and the lower inner circumferential surface and a lower surface of the horizontal portion defining a second edge pressure chamber located below the first edge pressure chamber, the upper inner circumferential surface extends upwardly from the horizontal portion of the second edge circumferential wall, and the lower inner circumferential surface extends downwardly from the horizontal portion of the second edge peripheral wall.

7. The substrate holding apparatus according to claim 6, wherein the upper inner circumferential surface and the lower inner circumferential surface lie in a same plane.

8. The substrate holding apparatus according to claim 6, wherein an annular groove extending in a circumferential direction of the first edge circumferential wall is formed in the lower inner circumferential surface.

9. The substrate holding apparatus according to claim 8, wherein the annular groove is located at a lower end of the lower inner circumferential surface.

10. The substrate holding apparatus according to claim 6, wherein the elastic membrane further comprises a third edge circumferential wall located radially inwardly of the second edge circumferential wall, the third edge circumferential wall having a lower end connected to the contact portion, the lower end of the third edge circumferential wall being located adjacent to the first edge circumferential wall.

11. A polishing apparatus comprising:

a polishing table for supporting a polishing pad; and a substrate holding apparatus configured to press a substrate against the polishing pad, the substrate holding apparatus including an elastic membrane that forms pressure chambers for pressing the substrate, a head body to which the elastic membrane is secured, and a retaining ring surrounding the elastic membrane, wherein the elastic membrane comprises (i) a contact portion to be brought into contact with the substrate for pressing the substrate against the polishing pad, (ii) a first edge circumferential wall extending upwardly from a peripheral edge of the contact portion, and (iii) a second edge circumferential wall having a horizontal portion connected to an inner circumferential surface of the first edge circumferential wall, the inner circumferential surface of the first edge circumferential wall includes an upper inner circumferential surface and a lower inner circumferential surface, both of which are perpendicular to the contact portion, the upper inner circumferential surface and an upper surface of the horizontal portion defining a first edge pressure chamber, and the lower inner circumferential surface and a lower surface of the horizontal portion defining a second edge pressure chamber located below the first edge pressure chamber, the upper inner circumferential surface extends upwardly from the horizontal portion of the second edge circumferential wall, and the lower inner circumferential surface extends downwardly from the horizontal portion of the second edge peripheral wall.

12. The polishing apparatus according to claim 11, wherein the upper inner circumferential surface and the lower inner circumferential surface lie in a same plane.

13. The polishing apparatus according to claim 11, wherein an annular groove extending in a circumferential direction of the first edge circumferential wall is formed in the lower inner circumferential surface.

14. The polishing apparatus according to claim 13, wherein the annular groove is located at a lower end of the lower inner circumferential surface.

15. The polishing apparatus according to claim 11, wherein the elastic membrane further comprises a third edge circumferential wall located radially inwardly of the second edge circumferential wall, the third edge circumferential wall having a lower end connected to the contact portion, the lower end of the third edge circumferential wall being located adjacent to the first edge circumferential wall.

16. The elastic membrane according to claim 1, wherein the first edge circumferential wall includes a fold portion connected to the upper inner circumferential surface, and wherein the upper inner circumferential surface, the fold portion, and the upper surface of the horizontal portion defines the first edge pressure chamber.

17. The substrate holding apparatus according to claim 6, wherein the first edge circumferential wall includes a fold portion connected to the upper inner circumferential surface, and wherein the upper inner circumferential surface, the fold portion, and the upper surface of the horizontal portion defines the first edge pressure chamber.

18. The polishing apparatus according to claim 11, wherein the first edge circumferential wall includes a fold portion connected to the upper inner circumferential surface, and wherein the upper inner circumferential surface, the fold portion, and the upper surface of the horizontal portion defines the first edge pressure chamber.

* * * * *